United States Patent [19]

Haigh et al.

[11] Patent Number: 5,058,241

[45] Date of Patent: Oct. 22, 1991

[54] METHOD AND APPARATUS FOR COMBINING FIBRES FORMED INTO SLIVERS FOR SUPPLY TO TEXTILE MACHINERY

[75] Inventors: John S. Haigh, Addingham, United Kingdom; Gian M. Nelva, Andorno Micca, Italy

[73] Assignees: Caipo Engineering System S.r.l., Campore-Biella, Italy; Iws Nominee Co. Limited, London, England

[21] Appl. No.: 531,357

[22] Filed: May 31, 1990

[30] Foreign Application Priority Data

May 31, 1989 [IT] Italy ..... 67423 A/89

[51] Int. Cl.[5] ..... D01G 21/00

[52] U.S. Cl. ..... 19/150; 28/114

[58] Field of Search ..... 28/107–114; 112/27; 19/150

[56] References Cited

U.S. PATENT DOCUMENTS

| | | | |
|---|---|---|---|
| 2,845,687 | 8/1958 | Howard | 28/114 |
| 3,112,549 | 12/1963 | Smith, II | 28/113 X |
| 3,483,601 | 12/1969 | Smith, II | 28/108 |
| 3,494,310 | 2/1970 | Merkle | 112/27 |
| 3,535,756 | 10/1970 | Kuts et al. | 28/114 |
| 4,205,113 | 5/1980 | Hermansson et al. | 28/109 X |
| 4,404,717 | 9/1983 | Neubauer et al. | 28/107 |

FOREIGN PATENT DOCUMENTS

| | | | |
|---|---|---|---|
| 432451 | 9/1967 | Switzerland | 28/108 |

*Primary Examiner*—Werner H. Schroeder
*Assistant Examiner*—John J. Calvert
*Attorney, Agent, or Firm*—Sughrue, Mion, Zinn, Macpeak & Seas

[57] ABSTRACT

The tail end of a first sliver and the leading end of a second sliver are superposed and clamped together and their fibres are then combined by means of a plurality of needles which are reciprocated through the ends of the two strips transverse thereto.

9 Claims, 3 Drawing Sheets

METHOD AND APPARATUS FOR COMBINING FIBRES FORMED INTO SLIVERS FOR SUPPLY TO TEXTILE MACHINERY

BACKGROUND OF THE INVENTION

The present invention relates in general to slivers of fibres of any kind and size for supply to textile machinery such as preparatory machines for spinning, combing, straightening, etc. When supplied to such machines, the slivers of fibres may break or simply run out and cause the machine to stop until the correct supply conditions have been re-established by the joining of a second sliver to the end of the sliver which has broken or run out.

In order to eliminate the need for manual joining of the slivers, and consequent long stoppages in which the machine is inoperative, the use has been proposed (for example in Italian patent application No. 67470-A/86) of a compressed-air system which produces an air jet through one or more fixed or movable nozzles, directed at the ends of the two slivers which are arranged in contact, so as to mat their fibres which thus become bound together.

These systems are not always effective and, in particular, have been found unsuitable for slivers with short fibres in which the turbulence of the air jet tends to open up the slivers and not to fix them together as desired. These systems are also unsuitable for wet fibres since the air jet cannot achieve the necessary matting.

SUMMARY OF THE INVENTION

The object of the present invention is to avoid the aforesaid problems and to provide a method and apparatus which can effectively combine together fibres of any kind, provided in slivers of any shape and size, and which are suitable for natural and synthetic fibres, short fibres, long fibres, dry fibres and/or wet fibres.

The method according to the invention is characterised in that it consists of superposing and clamping together the tail end of a first sliver and the leading end of a second sliver and reciprocating a plurality of needles through the fibres in the ends of the two slivers, transverse the slivers.

The ends of the two slivers are normally superposed and clamped together with their respective fibres parallel.

The method according to the invention produces joins whose quality does not depend on the ability of the operator and which also reduces drastically the stoppages in the supply to the textile machine when the sliver breaks or runs out: in fact, when this happens, a reserve sliver of the same type as that being supplied is provided and, in a very short time, is joined to the tail end of the latter by means of the needles. The joining can be carried out manually or, more advantageously, automatically. In this case, the method further includes a step of detecting the presence of the tail end of the sliver being supplied in order to stop it advancing and automatically causing the leading end of the reserve sliver to be superposed and clamped thereon, as well as causing the needles to penetrate the superposed, clamped ends of the two slivers.

The apparatus according to the invention for carrying out the aforementioned method includes means for superposing and clamping together the tail end of the first sliver and the leading end of the second sliver with their respective fibres parallel, at least one unit with needles arranged transverse the plane of the slivers, and means for reciprocating the needles through the fibres at the ends of the slivers after they have been clamped.

In greater detail, the apparatus comprises a base beneath which the needle unit is situated, the base having a horizontal wall on which the sliver is supported for sliding movement and which has a conformation such that the needles can pass through it, and an upper structure for holding the second sliver, the structure being movable vertically relative to the base between a raised position and a lowered position in which the ends of the two slivers are superposed and clamped.

If the joining cycle is carried automatically, the apparatus to advantage includes detector means for generating an electrical signal indicative of the presence of the tail end of the first sliver and an electronic control unit which is connected to the detector means and is arranged, as a result of the generation of the signal, to cause, in sequence, the stoppage of the first sliver with its tail end in correspondence with the needle unit, the lowering of the upper holding structure in order to superpose and clamp the leading end of the second sliver on to the tail end of the first sliver, the activation of the needle unit for a predetermined number of cycles and the subsequent re-establishment of the supply.

BRIEF DESCRIPTION OF THE DRAWINGS

The invention will now be described in detail with reference to an embodiment which carries out the joining cycle automatically with apparatus having a single needle unit and with reference to the appended drawings, provided purely by way of non-limiting example, in which.

DETAILED DESCRIPTION OF THE INVENTION

Figure 1:
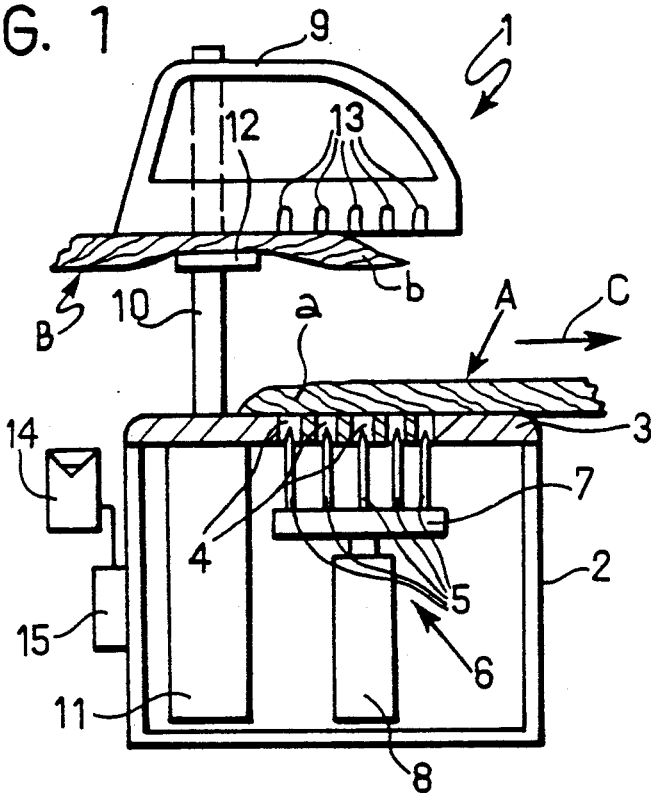
FIG. 1 is a partially-sectioned side elevation of apparatus according to the invention shown at a first stage in the joining method.
Figure 2:
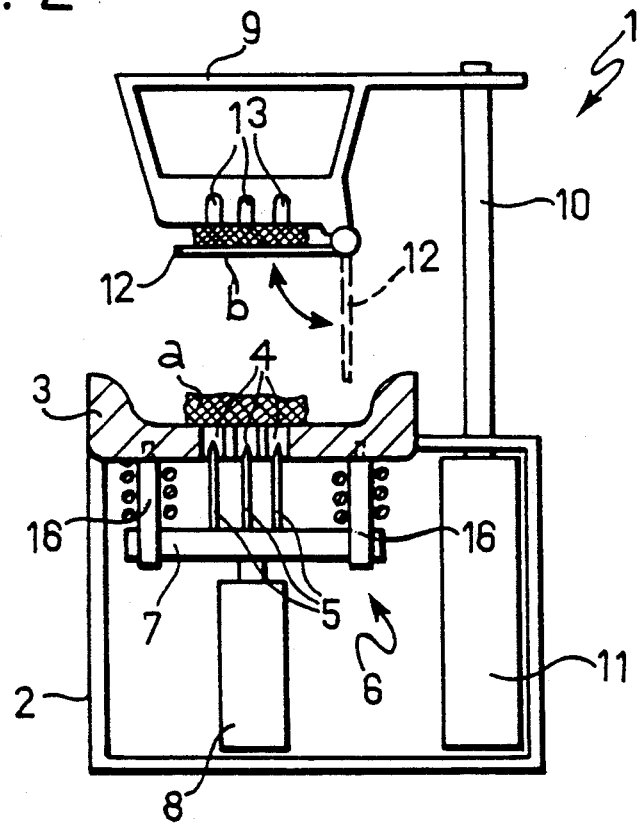
FIG. 2 is a partially-sectioned front elevation of FIG. 1, FIGS. 3 and 4 are two views similar to FIG. 1 at two subsequent stages in the joining method.

With reference initially to FIGS. 1 and 2, apparatus according to the invention for joining together the tail end a of a first sliver of fibres A and the leading end b of a second sliver of fibres B is generally indicated 1. In the embodiment illustrated, the sliver A is that supplied to a textile machine (for example a preparatory machine for spinning, combing, straightening, or the like), and is normally moving in the direction of advance indicated by the arrow C. The sliver B is a reserve sliver which is normally kept stationary and its leading end b is intended to be joined to the tail end a of the sliver A if the latter breaks or runs out, in the manner explained below.

Figure 3:
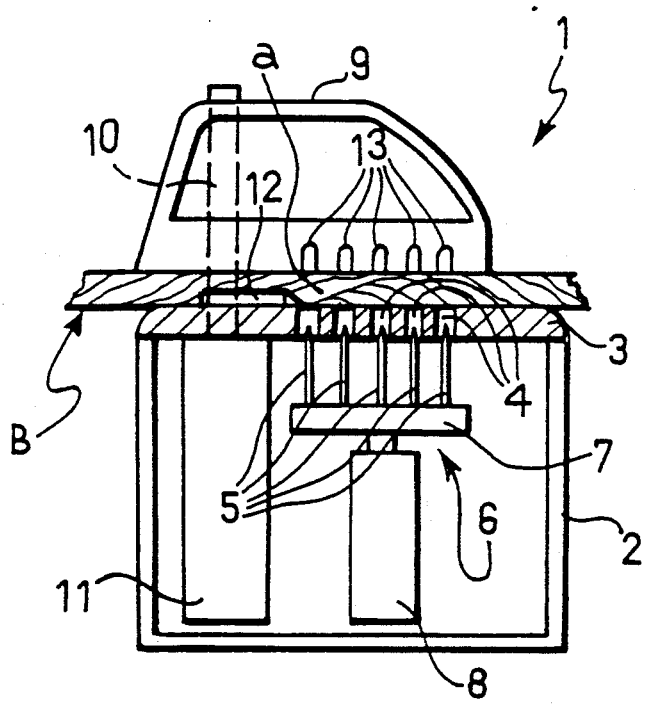

The apparatus 1 comprises essentially a lower base 2 with a horizontal support wall 3 on which the sliver A normally slides. As shown in detail in FIG. 2, the wall 3 has a channel-shaped conveyor cross-section with central perforations 4 in correspondence with which are arranged needles 5 of a needle unit 6 housed in the base 2. The needle unit 6 comprises a plate 7 from which the needles 5 project vertically and which can be reciprocated vertically along guides 16, for example by means of a pressurised-fluid actuator 8, between the lowered position shown in FIGS. 1 to 3 and the raised position shown in FIGS. 4 and 5. The needles 5 do not project from the support wall 3 in their lowered positions, but, in their raised positions, they project therefrom through the holes 4.

A structure for holding the reserve sliver B is situated above the base 2 and is indicated 9. The holding structure 9 is in the form of a movable jaw member carried by an upright 10 which is movable vertically, for example by means of a pressurised-fluid actuator 11, between the raised position shown in FIGS. 1 and 2 and the lowered position shown in FIGS. 3 to 5. In the raised position, the movable member 9 is spaced vertically from the base 3 whilst, in the lowered position, it is adjacent the base 3.

The movable member 9 has a movable member 12 for clamping the end b of the reserve sliver B, which is movable (for example by means of a pressurised-fluid actuator not shown) between the raised, operative position shown in continuous outline in FIG. 2 and the lowered, release position shown in broken outline in the same drawing. The movable member 9 also has a plurality of recesses 13 formed in its lower face in positions corresponding to those of the perforations 4 in the support wall 3.

The actuators described above for the needle unit 6, the upper holding member 9, and the clamping member 12 can be operated manually or, more advantageously, automatically in a sequential cycle as explained below. For automatic operation, a conventional electrical detector 14 is provided for detecting the breakage or running-out of the sliver A being supplied and sending a corresponding signal to an electronic control unit 15 which in turn activates the aforesaid actuators.

The operation of the apparatus 1 in carrying out a cycle for joining the tail end a of the sliver A being supplied to the leading end b of the reserve sliver B will now be described, starting from the condition shown in FIG. 1 in which the detector 14 has signalled the breakage or running-out of the supply sliver A to the electronic control unit 15. As a result of this signal, the sliver A is stopped in the position in which its tail end a, supported by the wall 3, is situated in correspondence with the perforations 4, and hence with the needles 5 of the needle unit 6. The sliver A is stopped simply by stoppage of the textile machine which is taking it in by controlled braking in the conventional manner.

After the sliver A has been stopped, the actuator 11 is activated and moves the holding member 9 from its raised position to its lowered position with the clamping member 12 kept in its raised, operative position. The end b of the reserve sliver B is thus superposed on the end a of the sliver A and the ends are clamped between the wall 3 of the base 2 and the holding member 9 (FIG. 3) with their respective fibres parallel.

Figure 4:
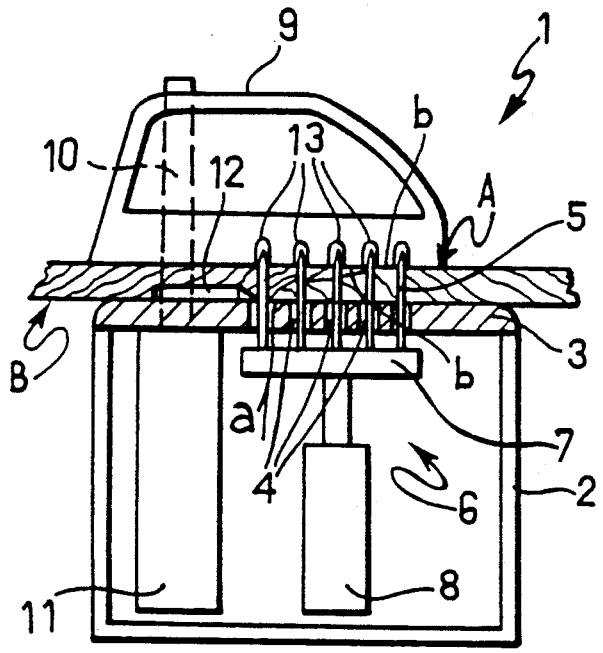
Figure 5:
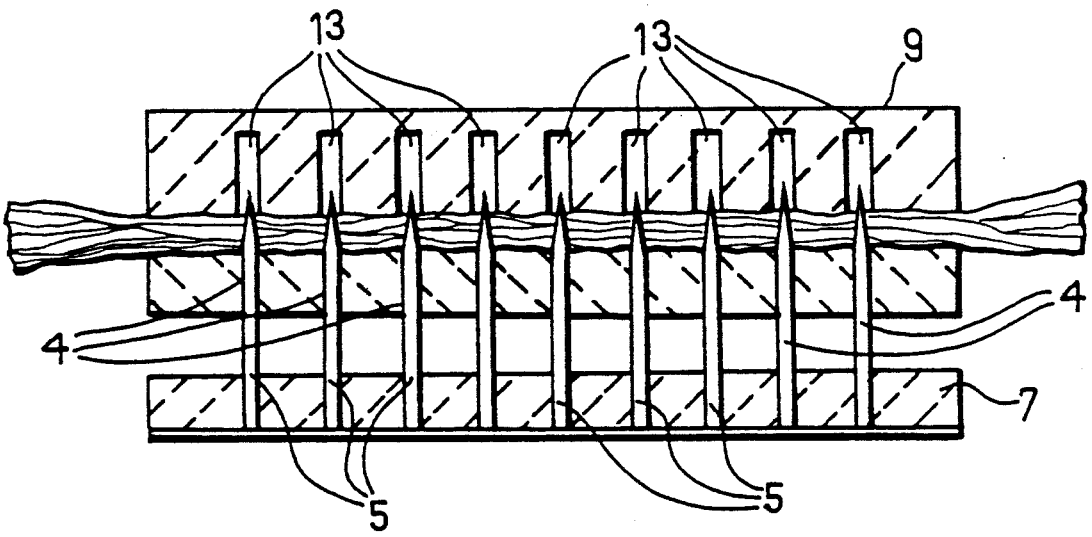
FIG. 5 shows a detail of FIG. 4 on an enlarged scale.

At this point, the actuator 8 is activated and alternately raises and lowers the plate 7 carrying the needles 5 which cyclically penetrate the ends a, b, passing through their fibres several times so as to lint them with a uniform distribution and form an effective join even in the most difficult conditions (short fibres, wet fibres) (FIGS. 4 and 5).

At the end of a predetermined cycle (which may be programmable by means of the control unit 15) of reciprocating movements of the unit 6, the latter is stopped in its lowered position, the holding member 9 is raised and the clamping member 12 lowered to enable the supply of the sliver to the textile machine to be resumed. A new reserve sliver is put in place and the clamping element 12 is closed against the holding member 9 ready for a subsequent join should the sliver being supplied break or run out.

The restarting of the textile machine to re-establish the supply of the sliver may be controlled automatically by the electronic control unit 15 or manually, possibly after the emission of a light signal generated by the unit 15 to attract the operator's attention.

The apparatus for supplying the textile machine may include a plurality of pieces of apparatus 1 as described above, one for each sliver supplied to the textile machine to be served.

Alternatively, in other textile machines such as, for example, straighteners, a single device 1 may be rendered movable so that it can be slid manually by the operator, or automatically on a suitable guide (not shown), in order to join the slivers and thus form qualitatively perfect joints with simple and cheap apparatus in accordance with the principles of the invention.

Figure 6:
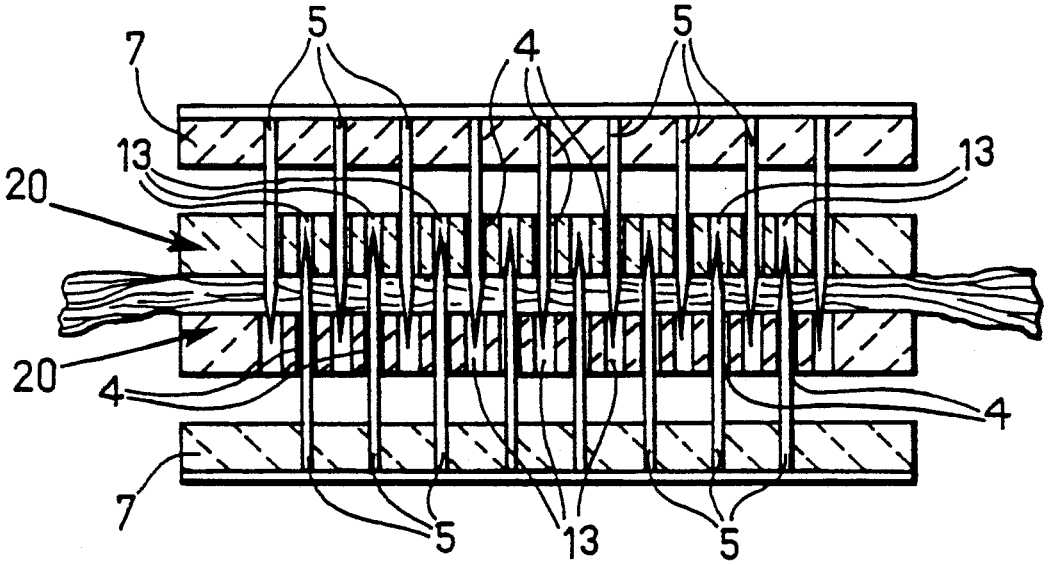
FIG. 6 shows a variant of FIG. 5.

In another embodiment, shown in FIG. 6 (in which parts identical or similar to those described above are indicated by the same reference numerals), in addition to the means for superposing and clamping together the tail end of the first sliver and the leading end of the second sliver with their respective fibres parallel, there are two opposed needle units and means for reciprocating the two needle units in mutually opposed directions through the fibres of the superposed slivers.

Both of the needle units are constituted, for example, by perforated plates 20 whose holes 13 are occupied by the needles 5 in a precise geometrical arrangement such that each plate has a through hole in correspondence with each needle of the other plate, and vice versa, so as to prevent collisions between the needles during the reciprocating movements of the plates.

Finally, it should be noted that, instead of being stationary during the reciprocating movement of the needle unit (both in the case of a single unit and in the case of two opposed units), the two slivers may be advanced in the direction of supply of the machine, in synchronism with the reciprocating movement of the needles: the join is thus effected over a desired area (depending on the number of cycles) regardless of the number of needles present in the needle units. The dimensions of the needle units can thus be reduced.

What is claimed is:

1. A method of joining the tail end portion of a first sliver of textile fibres to the leading end portion of a second sliver of said textile fibres, comprising superposing and clamping together said tail end portion and said leading end portion and reciprocating a plurality of needles through said superposed end portions in a direction transverse the planes of said end portions in order to join said end portions together.

2. A method as claimed in claim 1, wherein said end portions are superposed and clamped together with their respective said fibres substantially parallel.

3. A method as claimed in claim 1, wherein said first sliver is movable to supply a textile machine whilst said second sliver is a stationary reserve sliver, said method further includes a step of detecting the presence of said tail end portion of said first sliver, stopping the advance of said first sliver upon detection of said tail end portion and automatically effecting the superposition, clamping and joining operations.

4. A method as claimed in claim 1, wherein during the reciprocating movement of said plurality of needles, said slivers are advanced longitudinally of said first sliver in synchromism with the reciprocating movement of said needles.

5. Apparatus for joining the tail end portion of a first sliver of textile fibres to the leading end portion of a second sliver of said textile fibres, wherein said apparatus includes means for superposing and clamping together said tail end portion and said leading end portion with their respective said fibres parallel, means for reciprocating said means for clamping;

at least one needle unit with a plurality of needles arranged transverse the plane of said end portions in their clamped condition; and means for reciprocating said needles (5) through said end portions in their clamped condition in order to join them together.

6. Apparatus as claimed in claim 5, wherein said apparatus includes a base having a horizontal wall for supporting said first sliver for sliding movement, said needle unit being located beneath said base and said wall having a conformation such that said needles can pass through said base and said wall; and an upper structure for holding said second sliver, said structure being movable vertically relative to said base between a raised position and a lowered position in which said end portions are superposed and clamped.

7. Application as claimed in claim 6, wherein said apparatus further includes detector means for detecting the presence of said tail end of said first sliver and for generating an electrical signal indicative of said presence; and an electronic control unit connected to said detector means and arranged, as a result of the generation of said signal, to cause, in sequence, the stoppage of said first sliver with said tail end in correspondence with said needle unit, the lowering of said upper structure in order to superpose and clamp said leading end of said second sliver on to said tail end of said first sliver, the activation of said needle unit to effect a predetermined number of reciprocating movements to join said end portions, and the subsequent re-establishment of the movement of the joined slivers.

8. Apparatus as claimed in claim 5, wherein guide means are provided on which said apparatus is movable to a position in correspondence with the said tail end of said first sliver.

9. Apparatus as claimed in claim 5, wherein said apparatus includes two said needle units arranged on opposite sides of the general plane of said end portions in their clamped condition whereby the needles of the two units are reciprocated through the end portions from opposite sides.

* * * * *